US005459475A

United States Patent [19]

Shen et al.

[11] Patent Number: 5,459,475

[45] Date of Patent: Oct. 17, 1995

[54] WIDE SCANNING SPHERICAL ANTENNA

[75] Inventors: Bing Shen, Harrison Township, Mich.; Warren L. Stutzman, Blacksburg, Va.

[73] Assignees: Center for Innovative Technology, Herndon; Virginia Polytechnic Institute and State University; Virginia Tech Intellectual Properties, Inc., both of Blacksburg, all of Va.

[21] Appl. No.: 172,127

[22] Filed: Dec. 22, 1993

[51] Int. Cl.[6] ..... H01Q 19/19

[52] U.S. Cl. ..... 343/781 P; 343/761; 343/781 CA; 343/839

[58] Field of Search ..... 343/781 R, 781 P, 343/754, 837, 761, 839, 781 CA; H01Q 19/12, 19/13, 19/18, 19/19

[56] References Cited

U.S. PATENT DOCUMENTS

| | | | |
|---|---|---|---|
| 3,641,577 | 2/1972 | Tocquec | 343/839 X |
| 3,793,637 | 2/1974 | Meek | 343/761 |
| 3,795,003 | 2/1974 | Meek et al. | 343/761 X |
| 3,795,004 | 2/1974 | Meek et al. | 343/839 X |
| 4,042,933 | 8/1977 | Lapp | 343/761 |
| 4,062,018 | 12/1977 | Yokoi et al. | 343/761 X |
| 4,464,666 | 8/1984 | Watanabe et al. | 343/781 |
| 4,516,128 | 5/1985 | Watanabe et al. | 343/761 |
| 4,668,955 | 5/1987 | Smoll | 343/761 |

OTHER PUBLICATIONS

Kildal et al., "Synthesis of Multireflector Antennas by Kinematic and Dynamic Ray Tracing", IEEE Trans. Antennas Propagat., Oct. 1990, vol. 28, No. 10, pp. 1587–1599.

Nomoto, et al., "A Ku–Band 4–Beam Earth Station Antenna with a 6.5–m Fixed Spherical Reflector", Proc. of 14th International Comm. Satellite Sys. Cont. (Wash. D.C.), Mar. 1992, pp. 702–710.

*Primary Examiner*—Donald Hajec
*Assistant Examiner*—Tho Phan
*Attorney, Agent, or Firm*—Whitham, Curtis, Whitham & McGinn

[57] ABSTRACT

A novel method for calculating the surface shapes for subreflectors in a suboptic assembly of a tri-reflector spherical antenna system is introduced, modeled from a generalization of Galindo-Israel's method of solving partial differential equations to correct for spherical aberration and provide uniform feed to aperture mapping. In a first embodiment, the suboptic assembly moves as a single unit to achieve scan while the main reflector remains stationary. A feed horn is tilted during scan to maintain the illuminated area on the main spherical reflector fixed throughout the scan thereby eliminating the need to oversize the main spherical reflector. In an alternate embodiment, both the main spherical reflector and the suboptic assembly are fixed. A flat mirror is used to create a virtual image of the suboptic assembly. Scan is achieved by rotating the mirror about the spherical center of the main reflector. The feed horn is tilted during scan to maintain the illuminated area on the main spherical reflector fixed throughout the scan.

3 Claims, 9 Drawing Sheets

WIDE SCANNING SPHERICAL ANTENNA

This invention was made with government support under contract number NAG-1-859, awarded by NASA. The government has certain rights in this invention.

DESCRIPTION

BACKGROUND OF THE INVENTION

1. Field of the Invention

The present invention generally relates to spherical antennas and, more particularly, to wide-scanning, spherical antennas having a fixed, compact main spherical reflector.

2. Description of the Prior Art

Narrow beamwidth antenna systems are used in applications such as point-to-point communication systems which demand high gain antennas having high resolution. The antenna system of choice usually employs a large main reflector antenna because of its high gain and feed system simplicity. In many, if not most, applications the main beam of the antenna radiation pattern must be scannable over a region of space to permit spacial directivity and control of transmitted or received electro-magnetic waves. In communications applications varying traffic demands dictate scan coverage. In remote sensing applications a scanning scenario is employed to collect data over a desired observation region. Narrow beamwidth antennas are often physically large. Scanning by mechanically skewing or moving the entire antenna assembly is difficult and, in many situations, is unacceptable. For example, in space-based systems large-mass mechanical motions would disturb the space platform that might also support other systems which are vibration sensitive. It is, therefore, desirable to have a scanning system which does not involve motion of the main reflector. Such antenna systems typically accomplish scan through mechanical motion of a feed subassembly and/or through electronic means such as a phased array feed.

Performance during scan is, of course, also very important. Traditional directional antenna systems employ a well-focused parabola-shaped main reflector which accomplish scan by either motion of a few feeds, segmental excitation of several displaced feeds, or by phase steering a focal plane feed array. Unfortunately, such scanning systems can experience significant gain loss.

Spherical antenna systems have been developed which use a stationary spherical main reflector and a scanning feed subassembly. Traditional spherical antenna systems have low aperture utilization and poor side lobe and cross polarization characteristics, and are therefore not often used. Aperture utilization relates to the size of the antenna and is the ratio of the physical area of the main reflector to the area that is actually illuminated during scan, and is designate as:

$$\epsilon_u = \left( \frac{D'}{D} \right)^2$$

Where $\epsilon_u$ is the aperture utilization factor, D is the physical diameter of the main reflector, and D' is the diameter of the illuminated aperture. The spread of the illuminated aperture and the power distribution of the illuminated aperture remains constant with scan; however, the position of the illuminated aperture on the main reflector surface moves considerably. Thus, over-sizing of the main spherical reflector is necessary to prevent the beam from overshooting or spilling off of the main reflector during extreme scan angles.

This results in a poor aperture utilization factor which dictates a physically large antenna system.

There are several types of scanning spherical antenna systems. The simplest is the prime-focus spherical reflector which has a spherical reflector 2 and a feed subassembly 4, as shown in FIG. 1. The "focal point" is not an exact focal point as with a paraboloidal reflector; but rather is a caustic region known as the focal arc, designated by the letter "F". Scan is accomplished by moving the feed along the focal arc. The prime-focus spherical reflector requires a large F/D' ratio to limit the spherical aberration. Hence, scan is achieved at the expense of a large antenna structure with a small aperture utilization factor.

Dual-reflector systems have been developed which use a spherical main reflector and a subreflector which corrects for the spherical aberration and permits a smaller F/D'. This reduces the radius of the spherical main reflector so that the aperture utilization factor is improved somewhat. However, the power distribution on the illuminated portion of the main reflector cannot be controlled; thus, the side lobe and cross polarization performance is poor.

Tri-reflector systems have recently been developed which improve upon the side lobe and cross polarization performance of the dual-reflector systems. Tri-reflector systems include a main spherical reflector and two subreflectors. There have been two methods suggested for determining the shape of the subreflectors: a partial differential equation method and an optimization method. Kildal et at., Synthesis of Multireflector Antennas by Kinematic and Dynamic Ray Tracing, *IEEE Trans. Antennas Propagat.*, October, 1990, Vol.38, No. 10, pp. 1587–1599, discloses a partial differential equation method which uses an approximate numerical solution for a set of partial differential equations derived from kinematic and dynamic ray tracing. The Kildal et al. numerical solution is only an approximate solution because the feed-to-aperture mapping is allowed to float for purposes of calculation. U.S. Pat. Nos. 4,464,666 and 4,516,128 to Watanabe et al. disclose the optimization approach whereby the subreflectors surface shapes are calculated using a synthesis functional expansion. Each basis function in the expansion series satisfies the equal path length condition, correcting for spherical aberration. The coefficients in the series expansion are optimized to achieve the desired aperture distribution. Both the Kildal et al. and Watanabe et al. methods produce subreflectors for tri-reflector antenna systems which decrease the high side lobes and high cross polarization.

All of the foregoing spherical antenna systems have an aperture utilization factor, $\epsilon_u$, less than unity which leads to low aperture efficiency. Hence, the main reflector needs to be oversized to prevent spillover resulting in relatively large main reflector. Additionally, movement of the suboptic assembly during scan, although simpler than slewing the main reflector, is still relatively mechanically complex.

SUMMARY OF THE INVENTION

It is therefore an object of the present invention to provide a spherical scanning antenna having a compact, stationary main spherical reflector.

It is yet another object of the present invention to provide a tri-reflector spherical antenna where the illuminated aperture portion remains constant throughout the scan.

It is yet another object of the present invention to provide a spherical antenna having a main spherical reflector sized according to the illuminated aperture.

It is yet another object of the present invention to provide a tri-reflector spherical antenna having an aperture utilization factor close to unity.

It is yet another object of the present invention to provide a stationary scanning antenna and fixed suboptics which uses a flat mirror to rotate the image of the suboptics to perform scanning.

The invention is directed to a spherical tri-reflector antenna system that scans without gain loss and has near perfect aperture utilization (i.e. $\epsilon_u \cong 1$). A novel method is introduced for calculating the surface shapes of the suboptics which corrects for spherical aberration and cross polarization as well as allows control over the power distribution of the main reflector illuminated aperture. In a first embodiment of the invention, a suboptic assembly moves as a single unit to achieve scan while the main reflector remains stationary. The feed horn, from which the electromagnetic waves originate, is tilted during scan to maintain the illuminated area of the aperture fixed in the same spot on the surface of the main spherical reflector throughout the scan. Hence, the main spherical reflector need be no larger than illuminated area resulting in a physically compact system having $\epsilon_u \cong 1$.

In an alternate embodiment, both the main spherical reflector and the suboptic assembly are fixed. The invention includes a flat mirror used to create a virtual image of the suboptic assembly. Scan is achieved by rotating the mirror about the spherical center of the main reflector and translating it along a line. The rotation of the virtual image has the same effect as rotating the real image or the actual suboptic assembly itself; hence, the main beam is scanned accordingly.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
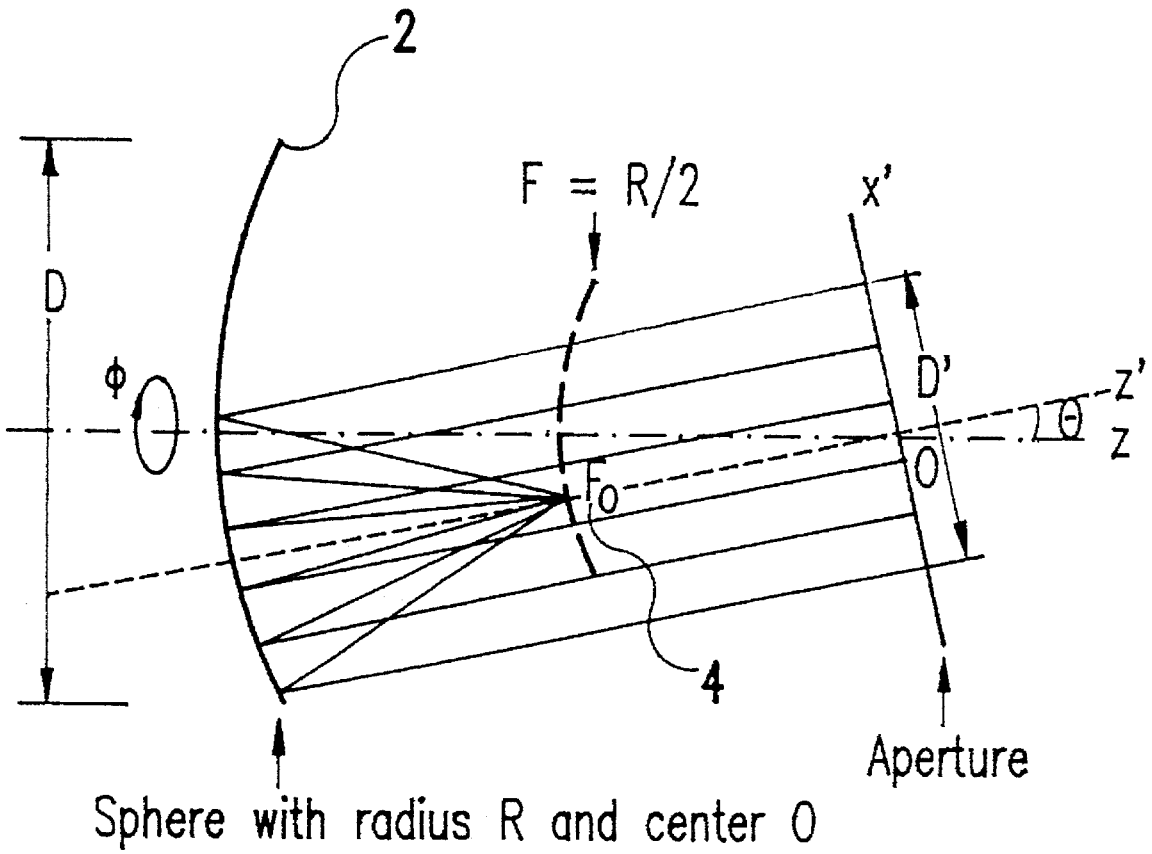
FIG. 1 PRIOR ART
FIG. 1 is a drawing of a simple prime focus spherical reflector.
Figure 2:
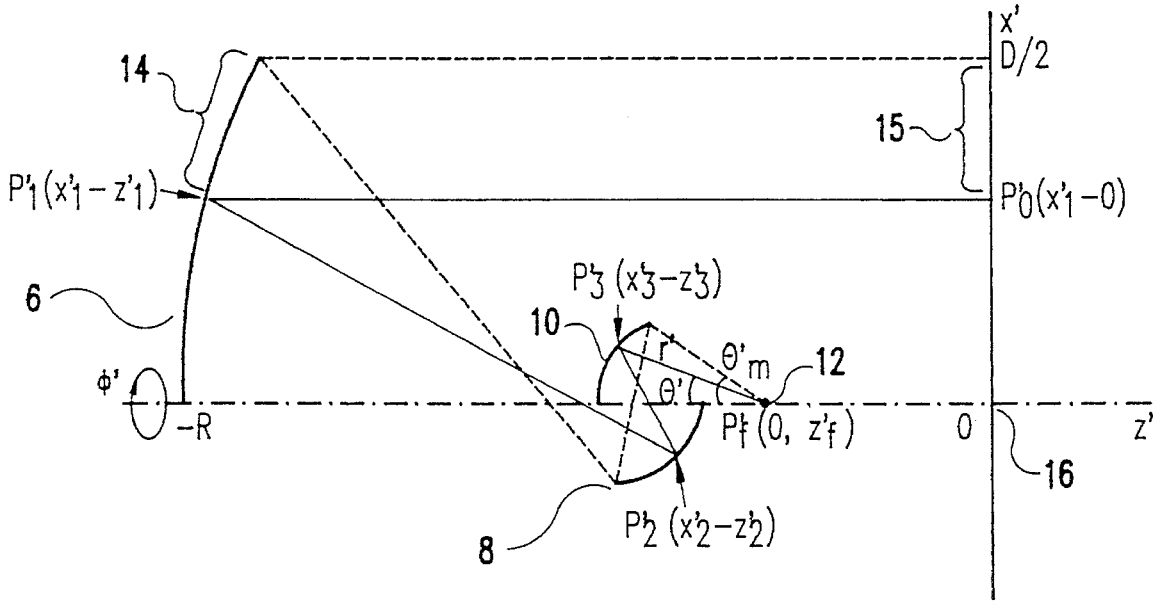
FIG. 2 is a drawing a dual-caustic, spherical, tri-reflector configuration used to synthesize the suboptic reflector shapes.

Referring now to FIG. 2, the antenna consists of an offset spherical main reflector 6, a subreflector 8, a tertiary reflector 10, and a feed horn 12. The suboptic reflector shapes, 8 and 10, are determined by modeling ideal axially symmetric suboptic reflector shapes that map rays from an ideal isotropic feed pattern to a uniform aperture plane distribution 14. This modeling procedure is an extension of Galindo-Israel's method of solving partial differential equations exactly to obtain reflector surface shapes.

The mapping between an ideal isotropic feed 12 and a uniform illuminated aperture 15 offers two major advantages. First, scan can be accomplished by rotating the suboptics assembly (including the feed 12, the tertiary 10 and the subreflector 8) along the R/2 spherical surface about the center 16 of the main spherical reflector 6, while tilting the feed 12 relative to the suboptics assembly to maintain illumination over the same part of the main reflector 6. This unique feature of a fixed illumination on the main reflector 6 eliminates the need for oversizing the main reflector 6 which, as discussed above plagued prior art spherical antenna systems. Hence, the main reflector 6 need be no larger than the illuminated aperture portion 14. Second, the aperture distribution can be controlled by the feed pattern. After modeling, the ideal isotropic feed 12 is replaced by a real feed with the desired radiation pattern. Still, a perfect one-to-one correspondence exists between the feed pattern and the aperture distribution 15. For example, if the feed has a Gaussian pattern, the aperture distribution will be Gaussian as well. This leads to very low side lobes and cross polarization levels.

The surface shapes of the subreflector 8 and the tertiary 10 are derived from an ordinary differential equation which is a generalization of Galindo-Israel's two-dimensional partial differential method. A profile view of the geometry used in the synthesis method is shown in FIG. 2. The suboptic reflectors, 8 and 10, modeled by rotating the profile of FIG. 2 360° about the z' axis (primed coordinates are introduced here and will be fixed relative to coordinates used to describe beam scanning). This forms an axisymmetric system that can be synthesized in two dimensions (2D), which is a significant simplification of the problem.

The behavior of the system in FIG. 2 is described using geometrical optics (GO) principles. The ray $P'_f P'_3 P'_2 P'_1 P'_0$ originating from the feed 12 located at $P'_f$ (0, $z'_f$) is reflected at $P'_3$ ($x'_3$, $z'_3$) on the tertiary 10, at $P'_2$ ($x'_2$, $z'_2$) on the subreflector 8, and $P'_1$ ($x'_1$, $Z'_1$) on the main reflector 6; finally, it leaves $P'_1$ parallel to the z' axis striking the aperture 15 at $P'_0$ ($x'_1$, 0). The feed angle, θ', is the angle of the ray $P'_f P'_3$ (the feed ray) off the feed axis (−z' axis). The length of $P'_f P'_3$ is r'. Therefore, $P'_3$ can be described in polar coordinates (θ', r'), which are related to the corresponding rectangular coordinates ($x'_3$, $z'_3$) as follows:

$$x'=r'\sin\theta'$$

$$z'_3=-r'\cos\theta'+z'_0 \quad (1)$$

The ray reflection points on the main reflector 6 and the subreflector 8 $P'_1$ ($x'_1$, $z'_1$) and $P'_2$ ($x'_2$, $z'_2$), respectively, are uniquely related to the feed ray $P'_f P'_3$ by ray tracing. In other words, $(x'_1, z'_1)$ and $(x'_2, z'_2)$ are functions of $(\theta', r')$. Moreover, r' is a function of θ', written as r'(θ'). The function r'(θ') can be solved by numerical methods for ordinary differential equations (ODE) if dr'/dθ' can be calculated at each point (θ', r'). Thus, after solution of the ODE all surface shapes are known to be points $P'_2(x'_2, z'_2)$ and $P'_3(x'_3, z'_3)$ as functions of angle θ'.

There are three steps in the derivation of the ODE required to perform the synthesis of the suboptics shapes. These steps are detailed below. They enforce the conditions of parallel rays 15 exiting the main spherical reflector 6, satisfaction of Snell's law of reflection on all reflectors, and a mapping of an isotropic feed pattern into a uniform aperture distribution 15.

The first step involves determining the feed-to-aperture mapping by evaluating the aperture point $P'_0(x'_1, \mathbf{0})$ for each θ'. The mapping between the feed pattern and the aperture power distribution leads to a functional relationship between θ' and $x'_1$, which can be uniquely solved in 2D (it is then immediately applicable to 3D axially symmetric systems; in 3D non-axisymmetric systems, an exact mapping from the given feed pattern to the desired aperture power distribution exists, but there is no unique functional relationship between each feed output ray direction and its aperture output location). The function $x'_1,(\theta')$ is obtained by solving the following power conservation relation between a feed ray cone and its corresponding aperture ray tube for the 3D axisymmetric system:

$$S_{ap}(x'_1)x'_1dx'_1d\phi'-U_f(\theta')\sin\theta'd\theta'd\phi' \tag{2}$$

where $S_{ap}$ is the aperture power intensity distribution in $W/m^2$ and $U_f$ is the feed radiation intensity in W/steradian. Canceling dφ' from both sides of (2) gives the following result:

$$S_{ap}x'_1dx'_1=U_f\sin\theta'd\theta' \tag{3}$$

The case of an isotropic feed pattern and a uniform aperture distribution results in taking $S_{ap}$ and $U_f$ to be constants in equation (3); then $S_{ap}$ and $U_f$ are related to each other through the total power conservation as follows:

$$\int_0^{\pm D/2} S_{ap}x'_1dx'_1=\int_0^{\theta'_m} U_f\sin\theta'd\theta' \tag{4}$$

where D is the diameter of the axially symmetric parent main reflector 6. The +/− signs on D/2 in the limits of integration correspond to "single-caustic" and "dual-caustic" configurations, respectively, which are discussed below. The ray corresponding to the feed angle $\theta'_m$ determines the edge of each of the three reflectors, 6, 8, and 10, as shown in FIG. 2; $\theta'_m$ sets the synthesis limit for the feed angle. The feed pattern is isotropic interior to $\theta'_m$ and is zero for feed angles θ' larger than $\theta'_m$; i.e. the feed has a sectoral pattern. Equation (4) determines $U_f/S_{ap}$. For convenience we define a "mapping normalization factor" as $q=\frac{1}{2}(U_f/S_{ap})R^{-2}$, where R is the radius of the main reflector 6. Then (3) can be rewritten as $$x'_1dx'_1=\frac{1}{2}qR^2\sin\theta'd\theta' \tag{5}$$

Integrating both sides yields $$x'^2_1=C-R^2q\cos\theta' \tag{6}$$

Constant C is the constant of integration that is determined by evaluating (6) for the vertex ray; this ray leaves the feed 12 along the −z' axis (θ'=0) and arrives in the aperture along the z' axis ($x'_1$=0). Using $x'_1$=0 and θ=0 in (6) gives $C=qR^2$. This in equation (6) gives $$x'_1=\pm R\sqrt{q(1-\cos\theta')} \tag{7}$$

Again, the +/− sign correspond to the dual-caustic and single-caustic solutions which are discussed below. Note that evaluation of (7) for the edge ray ($\theta'=\theta'_m$ and $x'_1=\pm D/2$) gives $$\frac{D}{2}=R\sqrt{q(1-\cos\theta'_m)}$$

which satisfies the total power conservation relation of equation (4); this relation shows how the main reflector 6 diameter D depends on q.

Since the main reflector 6 is of spherical shape, once $x'_1$ is determined $z'_1$ is readily obtained by the spherical surface relationship between $x'_1$ and $z'_1$ as follows:

$$z'_1=-\sqrt{R^2-x'^2_1} \tag{8}$$

To summarize, the first step establishes the functional relationship, equation (7), between the aperture point $P'_0$ and the feed angle θ' which satisfies the isotropic-to-uniform mapping. The ray exiting the feed 12 at angle θ' eventually strikes the aperture 15 at the point $P'_0(x'_1, \mathbf{0})$, where $x'_1$ is found from θ' by equation (7). Once the aperture point P' is found, the main reflector ray reflection point is found to be $P'_1(x'_1, z'_1)$ where $z'_1$ is found from $x'_1$ by equation (8).

The second step is to correct for spherical aberration. This is accomplished by shaping the subreflector 8 by evaluating $P'_2(x'_2, z'_2)$ based on the given $P'_1(x'_1, z'_1)$ and $P'_3(x'_3, z'_3)$. The spherical surface normal at $P'_1$ is first obtained. Knowing that the main reflector aperture output ray 15 must be parallel to the z' axis and, applying Snell's law determines the ray that goes through $P'_2$ and $P'_1$. The ray $P'_2P'_1$ gives the following linear relationship between $x'_2$ and $z'_2$:

$$x'=\left[1+\frac{2z'_1}{2z'^2_1-R^2}(z'_2-z'_1)\right]x'_1 \tag{9}$$

This relation is based on the fact that the point $P'_2(x'_2, z'_2)$ lies along the ray $P'_2,P'_1$. The location of the subreflector ray reflection point $P'_2$ along this ray path is determined by the constant total path length condition for the ray $P'_0P'_1P'_2P'_3P'_f$:

$$L=-z'_1+\sqrt{(z'_1-z'_2)^2+(x'_1-x'_2)^2}+\sqrt{(z'_2-z'_3)^2+(x'_2-x'_3)^2}+\sqrt{(z'_3-z'_f)^2+x'^2_3} \tag{10}$$

where the total path length L is a design parameter. This constant path length condition guarantees the correction of spherical aberration. Substituting equation (9) into equation (10) gives a single equation in terms of $z'_2$ that can be solved explicitly in terms of the given values for $P'_0$, $P'_1$, $P'_3$ and L. At this point the reflection points $(x'_1, z'_1)$, $(x'_2, z'_2)$ and $(x'_3, z'_3)$ can be calculated for an arbitrary ray that hits the tertiary 10 at (assumed) point (r', θ') which is equivalent to $(x'_3, z'_3)$ from equations (7) and (8) which yield $(x'_1, z'_1)$, then equations (9) and (10) yield $(x'_2, z'_2)$.

The third step establishes the required ODE based on the information from the previous steps which, in turn, is used to calculate the surface derivative on the tertiary reflector 10. The surface derivative is essentially equivalent to the surface normal which can be found from the Snell's law. Snell's law requires that the surface normal at point $P'_3$ on the tertiary reflector 10 bisects the angle between the feed-to-tertiary ray $P'_fP'_3$ and the tertiary-to-subreflector ray $P'_3P'_2$. The feed-to-tertiary ray is determined by the end points $P'_f(\mathbf{0}, z'_f)$ and $P'_3(x'_3, z'_3)$. The tertiary-to-subreflector ray is determined by the end points $P_3(x'_3, z'_3)$ and $P_2(x'_2, z'_2)$. Minimization of the ray path length $P'_f P'_3 P'_2$ will satisfy Snell's law and yields the following surface derivative relation:

$$\frac{dr'}{d\theta'} = \frac{-r[(z'_3 - z'_2)\sin\theta' + (x'_3 - x'_2)\cos\theta']}{\sqrt{(z'_3 - z'_2)^2 + (x'_3 - x'_2)^2 + [-(z'_3 - z'_2)\cos\theta' + (x'_3 - x'_2)\sin\theta']}} \quad (11)$$

Note that equation (11) is an ODE because the dependent variable in the derivative, r', also appears in the right hand side (RHS), and the RHS can be evaluated using the first and second steps from above once (r', θ') are known. Synthesis is performed by numerically solving equation (11) subject to a set of initial given conditions.

The initial values are those associated with the vertex ray. That is, the initial values are the coordinates of the vertex of each reflector. The radius R of the main reflector 6 is chosen so that the main reflector vertex is at ($x'_1$=0, $z'_1$=R). The subreflector vertex is located at ($x'_2$=0, $z'_2$=$z'_{20}$); the tertiary vertex is at ($x'_3$=0, $z'_3$=$z'_{30}$); the feed is at (0, $z'_f$). In addition to these initial values, q in equation (7) is an assumed value that is usually taken to be unity. The synthesis limit $\theta'_m$ is another design parameter which when combined with q value will determine the main reflector aperture diameter. Although total path length L in equation (10) is also a design parameter, it depends on the other initial given values. L is constant over all rays, and is, therefore, equal to that for the vertex ray from (0, $z'_f$) to (0, $z'_{30}$) to (0, $z'_{20}$) to (0, −R) to the origin, O, which is given by:

$$L=|z'_{30}-z'_f|+|z'_{20}-z'_{30}|+|-R-z'_{20}|+R \quad (12)$$

which relates L to the initial conditions. From this vertex ray with θ'=0 and r'=$|z'_{30}-z'_f|$, an 8th order Runge-Kutta method is used to solve the ODE. The Runge-Kutta method is analogous to the following procedure: for each iteration, θ' is incremented by Δθ' and dr'/dθ' is calculated from the three steps discussed above; then r' is incremented to the next value as r'+ (dr'/dθ')Δθ'. The Runge-Kutta iteration is performed up to the maximum feed angle when $\theta'=\theta'_m$.

Figure 3:
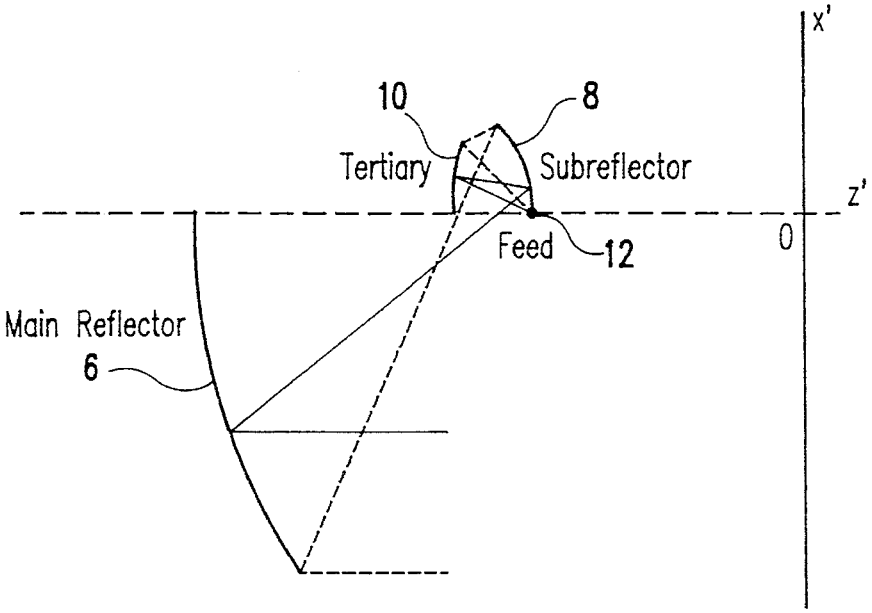
FIG. 3 is a drawing showing shows a single caustic spherical tri-reflector antenna system.

The choice of the sign in equation (7) yields different solutions. The two basic configurations corresponding to + and − are the dual-caustic and single-caustic systems, respectively. The dual-caustic system shown in FIG. 2 has caustics between the tertiary 10 and the subreflector 8, and between the subreflector 8 and the main reflector 6. The single caustic system shown in FIG. 3 has only one caustic between the subreflector 8 and the main reflector 6. In the dual-caustic system, the tertiary reflector 10 blocks the main reflector aperture 15. The performance of the dual-caustic configuration is limited at lower frequencies because of the extra caustic due to cusp diffraction. This is not a problem with the single-caustic design and, therefore, it is usually the preferred configuration. However, in the single-caustic system the feed 12 must be located along the z' axis between the spherical reflector focal point and the subreflector 8 to avoid blockage as shown in FIG. 3. In the dual-caustic system the feed can be placed anywhere along the z' axis facing the tertiary 10. Thus, the dual-caustic system is useful when feed location control is important.

The synthesis procedure described above gives parent surface shapes for the axially symmetric reflectors, 8 and 10. A multistage evolution is then performed to determine the reflector perimeters. The scan principles are discussed first, followed by an explanation of the perimeter determination process.

The configurations shown in FIGS. 4*a–f* show an offset intermediate reflector system which is used to illustrate main beam scanning to be adapted in the final reflector design. The axially symmetric configuration derived from the synthesis procedure for the single caustic system of FIG. 3 provides a family of parent reflector shapes. Of course, the ideal axisymmetric parent reflector configuration derived in the synthesis are not offset and therefore not practical since the positioning of the reflectors would block the beam. The offset intermediate reflector system with rectangular perimeters is formed from the axially symmetric parent system to avoid the blockage. During scan the intermediate reflector system together with the z' axis shown in FIGS. 4*a–f* are treated as a rigid system; that is, all three reflectors, 20, 22, and 24, the feed 26 and the z' axis moves as a unit.

In FIG. 2, a sectoral feed pattern with cone angle $\theta'_m$ was used to achieve uniform illumination on the main reflector 6. The feed 26 for the intermediate reflector system shown in FIGS. 4*a–f* is similar but has a sectoral pattern with a narrower cone angle. The intermediate feed 26 has cone angle $\theta_m$ with $\theta_m<\theta'_m$. In the final reflector system, the intermediate feed 26 serves to specify the spillover limit for a real feed (e.g. a Gaussian feed), the spillover is the portion of the beam pattern that is beyond the beam cone of the intermediate feed.

Figure 4A:
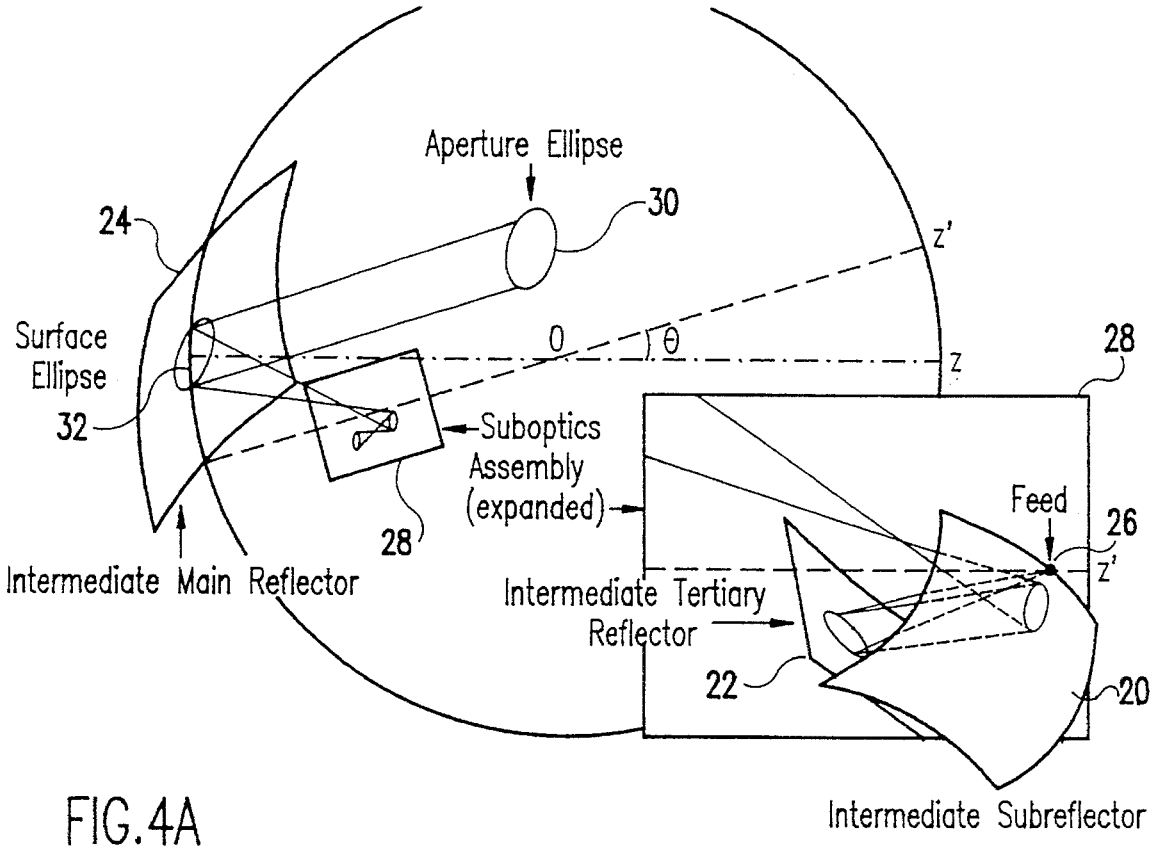
FIG. 4*a* is a drawing showing a 3D view of the intermediate configuration for a small θ-scan angle where $\phi=0°$.
Figure 4B:
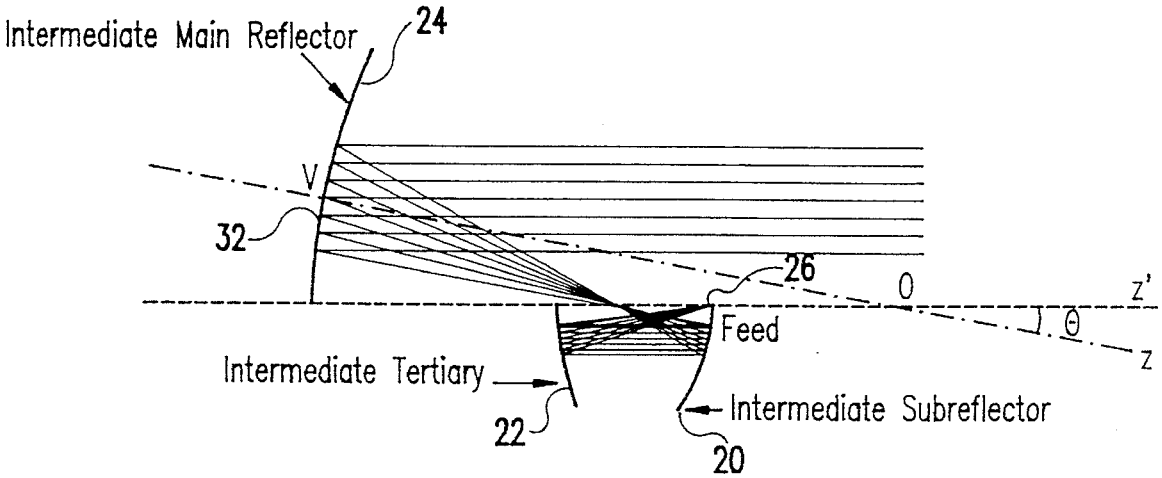
FIG. 4*b* is a drawing showing a profile view in the plane containing the z' and z axes for the case shown in FIG. 4*a;*
Figure 4C:
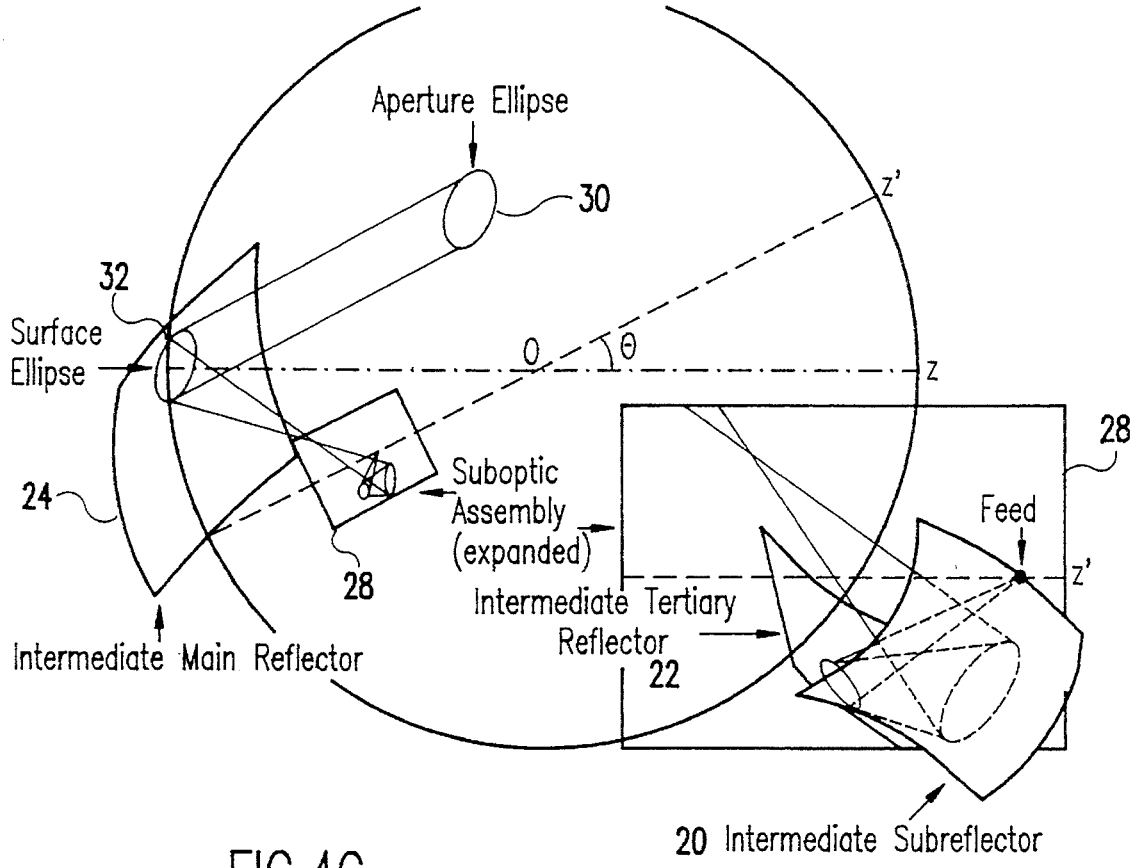
FIG. 4*c* is a drawing showing a 3D view of the intermediate configuration for large θ-scan and angle $\phi=0°$.
Figure 4D:
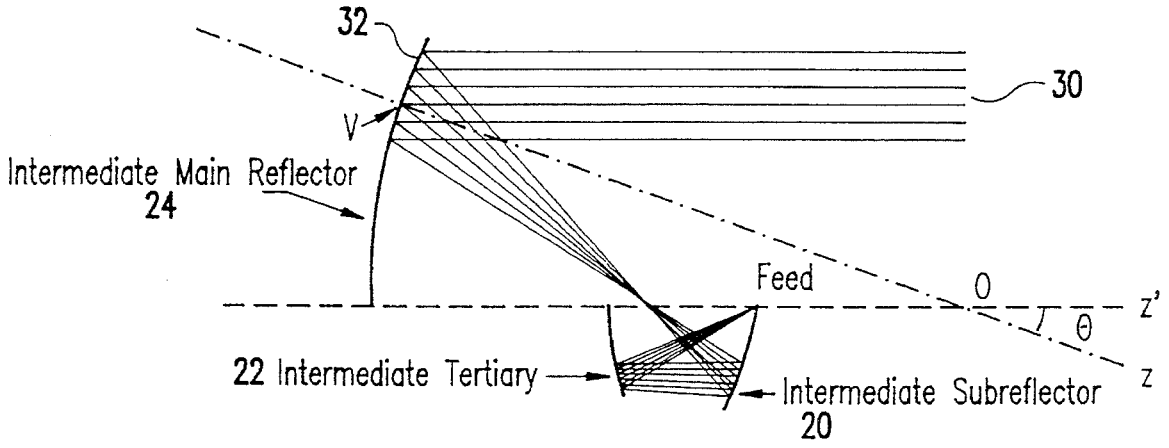
FIG. 4*d* is a drawing showing a profile view in the plane containing the z' and z axes for the case shown in FIG. 4*c;*
Figure 4E:
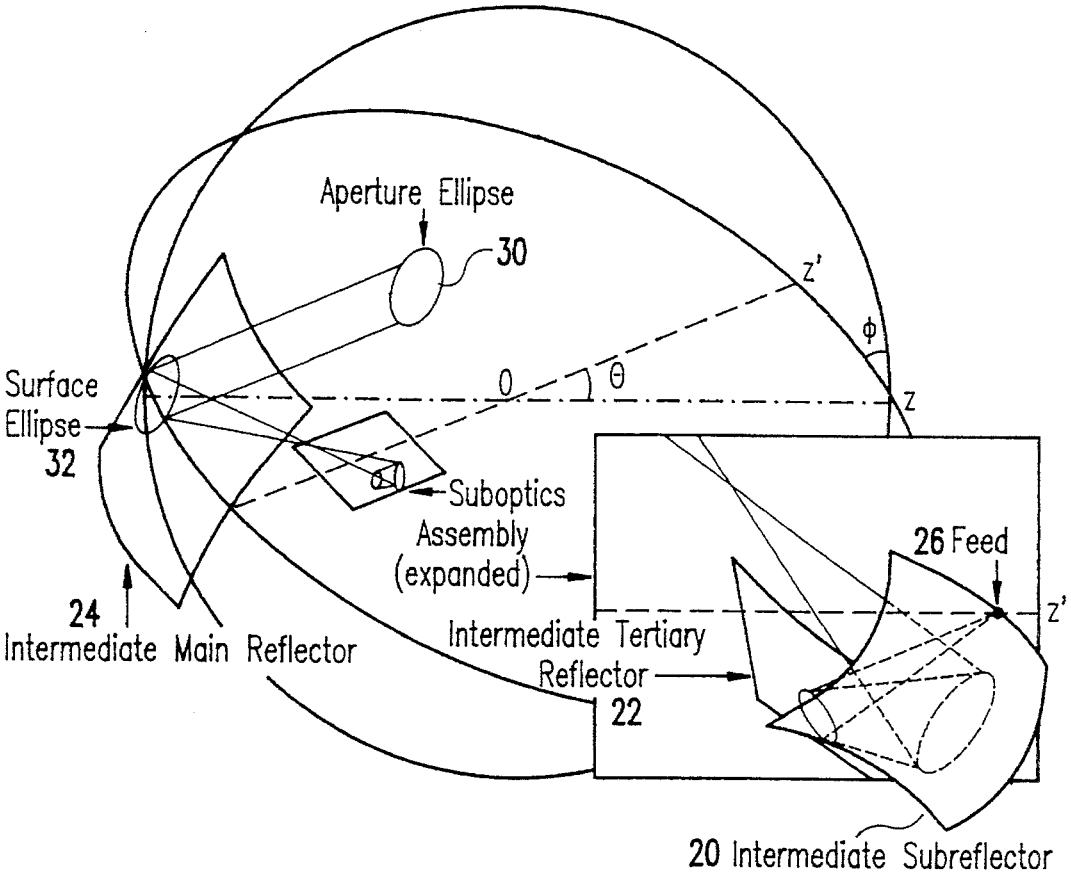
FIG. 4*e* is a drawing showing a 3D view of the intermediate configuration for large θ-scan and angle $\phi>0°$.
Figure 4F:
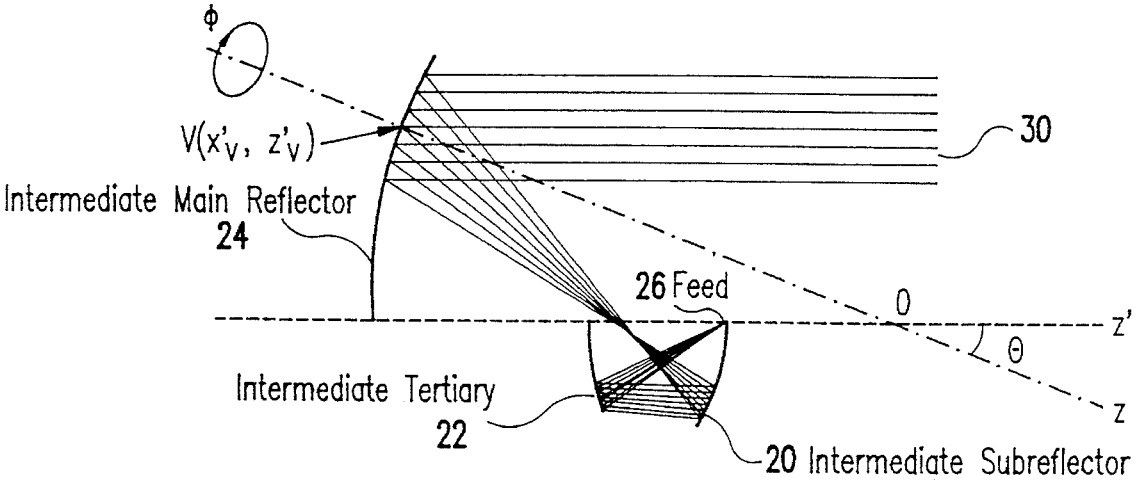
FIG. 4*f* is a drawing showing a profile view in the plane containing the z' and z axes for the case shown in FIG. 4*e;*

Scan is described in a spherical coordinate system (scan coordinate system) with a fixed z axis passing through the center of the illuminated portion of the main reflector, V, and the main reflector spherical center, O, as shown in FIGS. 4*b*, 4*d*, and 4*f*. The z' axis points in the direction (θ,ϕ) which is parallel to the output beam direction. Angle θ is between the z' and the z axes, and angle ϕ measures the rotation of the z' axis about the z axis as shown in FIG. 4*e*.

θ-scan is best visualized as a two step process. First, the entire intermediate system (including the z' axis, the intermediate main reflector 24 and suboptics assembly 28) is rotated about the spherical center, O, by angle θ. Of course, this rotation steers the main beam which is parallel to the z' axis. Although the intermediate main reflector 24 rotates with the intermediate system, the final main reflector can be fixed because it is spherical.

Second, the feed 26 is tilted relative to the z' axis within the intermediate system in order to keep the main reflector illumination center V fixed in the scan coordinates, see FIGS. 4*b* and *d*. Note that without the feed tilt, the illumination center moves with the intermediate main reflector 24. With feed tilt the illumination center V moves relative to the intermediate main reflector. The relative motion between V and the intermediate main reflector 24 cancels the movement caused by the motion of the intermediate main reflector so that V is stationary in the scan coordinate. Note that this step is possible because of the isotropic-to-uniform mapping; i.e. the feed pattern can be scanned with no resulting change in aperture taper.

Next is determined the amount of the feed tilt angle required to fix the main reflector illumination center V. The angle of feed tilt $\theta_f$ is the angle between the feed axis and the −z' axis. The ray emanating from the feed 26 along its axis is called the principal ray. The principal ray is reflected by the tertiary 22 and the subreflector 20 striking the main reflector 24 at V, which is $x'_v$ away from the z'-axis, as shown in FIG. 4*f*; and $x'_v$ is related to the scan direction θ by:

$$x'_v = R \sin\theta \tag{13}$$

The mapping function (7) evaluated under the condition $x'_1 = v'_v$, $\theta' = \theta'_f$ gives:

$$(x'_v)^2 = [R\sqrt{q(1-\cos\theta'_f)}\,]^2 \tag{14}$$

Substituting equations (13) into (14) gives $\theta'_f$ in terms of the scan angle $\theta$ as follows:

$$\theta'_f = \arccos\left(1 - \frac{1}{q}\sin^2\theta\right) \tag{15}$$

The intermediate configuration is shown for different $\theta$-scan angles in FIGS. 4*a* and *c*. The $\phi$-scan is accomplished by rotating the intermediate system about the z axis. This rotation steers the z' axis and the output beam direction in a conical fashion. FIGS. 4*c* and 4*d* illustrate cases with $\phi=0$ and $\phi>0$ beam directions, respectively. Since the z axis passes through the main reflector illumination center V, V does not move during $\phi$-scan. This permits the illuminated portion of the spherical main reflector to remain fixed during $\phi$-scan.

The reflectors derived from the synthesis process were visualized as having rectangular perimeters. The final subreflector and tertiary are derived from the intermediate subreflector and intermediate tertiary by trimming the edges to reduce their sizes. The final main reflector is derived according to the requirement that it has to cover the illuminated potion of the main sphere at all scan angles. Discussed following are methods to obtain the edge perimeter for each of the final reflectors.

The intermediate feed 26 (sectoral feed with beam cone angle $\theta_m$) is used for perimeter determination. The illuminated portions of the intermediate subreflector 20 and tertiary 22 change during $\theta$-scan due to the feed flit. For each scan angle $\theta$ the axis of the intermediate feed is tilted relative to the z' axis according to equation (15). The illumination edge contours on the intermediate tertiary 22 and subreflector 20 are obtained by tracing the cone of edge rays from the intermediate feed 26. The perimeters of the final subreflector and tertiary are obtained by sampling these illumination edge contours at several different $\theta$ angles over the desired $\theta$-scan range; the resulting illumination edge contours, which do not coincide, are used to select a final reflector perimeter which just accommodates those contours. The entire suboptics assembly in the final system is rotated about the z axis during $\phi$ scan as shown in FIG. 4*e*, with no relative motion within the suboptics assembly (including the feed). Therefore, the final subreflector and the tertiary need not be oversized to accommodate $\phi$ scan, and their perimeters can be determined from $\theta$-scan alone. This feature reduces the subreflector and tertiary sizes of the final system, because both reflectors are elongated only in one dimension.

The determination for the perimeter of the final main reflector is different from that for the final subreflector and tertiary because the final main reflector does not move during scan while the intermediate main reflector does. The final main reflector can remain stationary because of the spherical symmetry; rotating the main reflector alone about the center O does not have any effect on the performance of the antenna system.

The final main reflector must have a perimeter such that the edge rays strike it at all scan angles. Although the center of the main reflector illumination does not change, the illumination distribution changes only slightly during the scan. This is because the mapping in equation (7) is non-linear, which leads to an elliptical aperture edge ray contour from a feed with a circularly symmetric edge ray cone. Since a sectoral feed is used, we define the aperture ellipse 30 as the aperture illumination edge contour caused by the edge ray cone of the sectoral feed 26. The ratio between the two axes of the aperture ellipse is controlled by the constant q in equation (7).

The two axes of the aperture ellipse 30 are along the $\theta$ and the $\phi$ directions associated with the $\theta$ and $\phi$ angles in the scan coordinate system shown in FIG. 4*e*. The prudent choice for q is the one that makes the minor axis of the aperture ellipse 30 along $\theta$. As the $\theta$-scan angle increases the minor axis along $\theta$ decreases as seen in equation (7). When this aperture ellipse is projected onto the main reflector surface 32, an ellipse on the main reflector surface is created. The surface ellipse specifies the main reflector surface illuminated area 32. The minor axis of the aperture ellipse 30 along $\theta$ has to be multiplied by $\sec\theta$ to obtain the length of one axis of the surface ellipse. The $\sec\theta$ factor arises from the aperture-to-surface projection. The other axis of the surface ellipse has the same length as the major axis of the aperture ellipse along $\phi$. Since the minor axis is expanded by the $\sec\theta$ factor, the surface ellipse 32 is closer to a circle than the aperture ellipse 30.

The tact that the surface ellipse 32 is very close to circular is demonstrated by test cases. For example, for a single-caustic test case with 10° $\theta$-scan the surface ellipse has two axes of 9.9 m and 9.8 m. A circular main reflector illumination is important to $\phi$-scan, because the illumination rotates relative to the fixed final main reflector during $\phi$-scan. In general, oversizing the final main reflector is necessary to accommodate the illumination rotation. However, the design which yields an approximately circular surface illumination makes the oversizing unnecessary.

Although oversizing the final main reflector can be made unnecessary during scan, the size of the illuminated area on the main reflector will change when $\theta$-scan is performed. This is because we chose an isotropic feed to uniform aperture mapping rather than to uniform main reflector surface power distribution mapping. For the same sectoral feed the area A of the aperture ellipse remains constant independent of the $\theta$-scan angle. When the aperture ellipse 30 area A is projected onto the main reflector surface 32, the area of the surface ellipse is $A(\sec\theta)$, which increases with $\theta$. So the surface area of the final main reflector has to be determined according the maximum $\theta$-scan angle. By doing so, the main reflector is fully illuminated at the maximum $\theta$-scan angle, and partially illuminated at smaller $\theta$-scan angles. This is an automatic gain control process which guarantees constant gain throughout the scan region.

The cone angle $\theta_m$ for the intermediate feed 26 determines the final reflector perimeters. The illuminated area moves across the intermediate reflectors during $\theta$-scan; this requires extra area on each intermediate reflector. Smaller $\theta_m$ will result in smaller illuminated areas on the intermediate reflectors 20 and 22, which leads to smaller final reflector sizes and larger F/D, but a greater $\theta$-scan range. Therefore, the choice of $\theta_m$ involves a tradeoff. We use the following formula to estimate $\theta_m$:

$$2\theta_m = \theta'_m - \theta'_{fm} \tag{16}$$

where $\theta_m$ is the synthesis limit discussed above and $\theta_{fm}$ is the feed tilt angle at the maximum $\theta$-scan angle. $\theta_{fm}$ follows from (15) as:

$$\theta'_{fm} = \arccos\left(1 - \frac{1}{q}\sin^2\theta_{max}\right) \tag{17}$$

where $\theta_{max}$ is the maximum $\theta$-scan angle which is a design parameter.

Analysis was performed using GRASP7 code to verify the synthesis method. The numerical test configuration is the single caustic configuration listed in Table 1 below:

TABLE 1

Geometry Data and Analysis Results for a Single Caustic System

| Quantity | Value |
|---|---|
| θ-scan range | 10° |
| ϕ-scan range | 360° |
| frequency | 30 GHz |
| main spherical reflector | D = 10 m, R = 25 m |
| shaped subreflector size | 3.0 m × 1.6 m |
| shaped tertiary size | 2.4 m × 1.7 m |
| Gaussian feed | −12 dB tapered at ±16° |
| gain | 68.4 dB |
| gain variation in scan | ±0.03 dB |
| aperture efficiency | 70% |
| side-lobe level | <−25 dB relative to main beam peak |
| cross polarization | <−35 dB relative to main beam peak |
| beam efficiency | 85% |

This test configuration choice was motivated by the requirement for a narrow beam, earth scanning radiometer in geostationary (GSO) orbit. The antenna in GSO orbit should have a 25-m aperture diameter with ±5° scan region and operate at frequencies between 19 GHz and 60 GHz.

In order to reduce the computing time for the GRASP7 PO analysis of the test configuration, the linear dimension for the GSO orbit antenna is reduced by a factor of 2.5. Therefore, the numerical test model has a 10-m aperture diameter and other dimensions as shown in Table 1. The frequency for the analysis was taken as 30 GHz. A single frequency test is sufficient to verify our synthesis method, because the antenna system is synthesized using GO and its performance is frequency independent.

Figure 5:
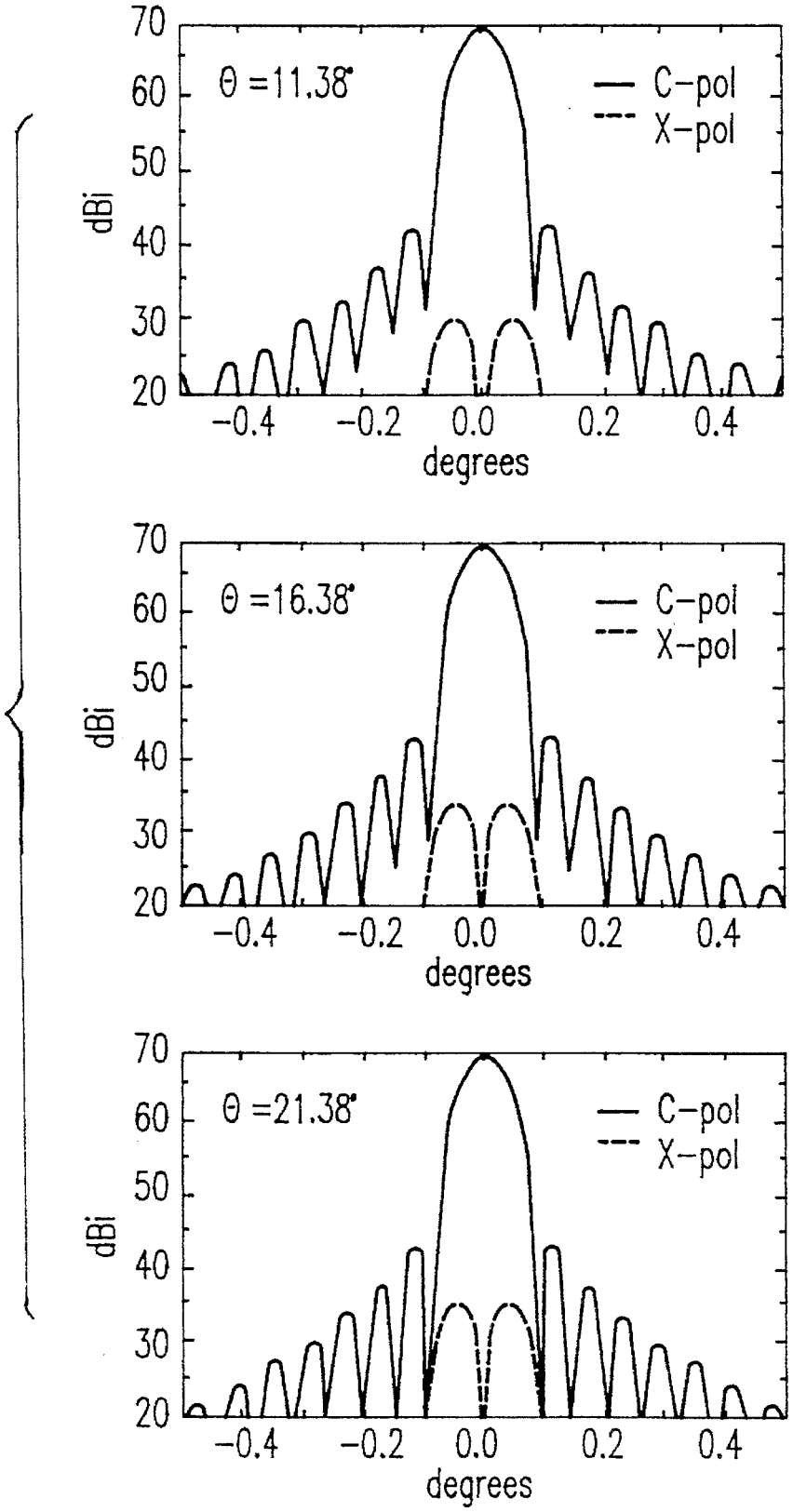
FIG. 5 is the H plane patterns of the tested single caustic system at various scan angles.

The desired scan region is ±5° in two directions from the center of the observation area for the GSO antenna. Our numerical test configuration is capable of a 10° θ-scan and a 360° ϕ-scan, which is more than required. Scan coordinates are shown in FIG. 4*e*. The θ-scan region is from θ=11.38° to 21.38°. PO analysis was performed at θ-scan angles of θ=11.38°,16.38° and 21.38° with ϕ=0°. The resultant H-plane patterns are shown in FIG. 5, and the values of the gain, the side lobe level and cross polarization level are given in Table 1, above. Since ϕ-scan is equivalent to rotating the whole antenna system in the ϕ direction and the antenna performance is not affected, the analysis for different ϕ angles is not necessary.

PO analysis results showed that the gain is constant throughout the scan region; this is, of course, because of the excellent scan quality offered by the symmetry of the spherical main reflector. The patterns of FIG. 5 have −25 dB side lobes. This is a significant improvement over the prior art single subreflector design. PO analysis also showed −35 dB cross polarization levels. The excellent side lobe and cross polarization levels are a result of a −12 dB edge tapered aperture illumination obtained from a Gaussian feed pattern which is −12 dB down at 16° off axis. The 70% aperture efficiency and 85% beam efficiency overcome the low efficiencies accompanied with traditional spherical main reflector system designs.

The spherical reflector antenna system of the present invention can be applied to both GSO and low earth orbit satellite wide scanning antennas. If the z-axis of the scan coordinate (see FIG. 4*e*) is directed from the satellite to the center of the earth, both the incidence angle of the beam and that of the polarization remain constant during scan. This is desirable in many remote sensing applications.

Figure 6:
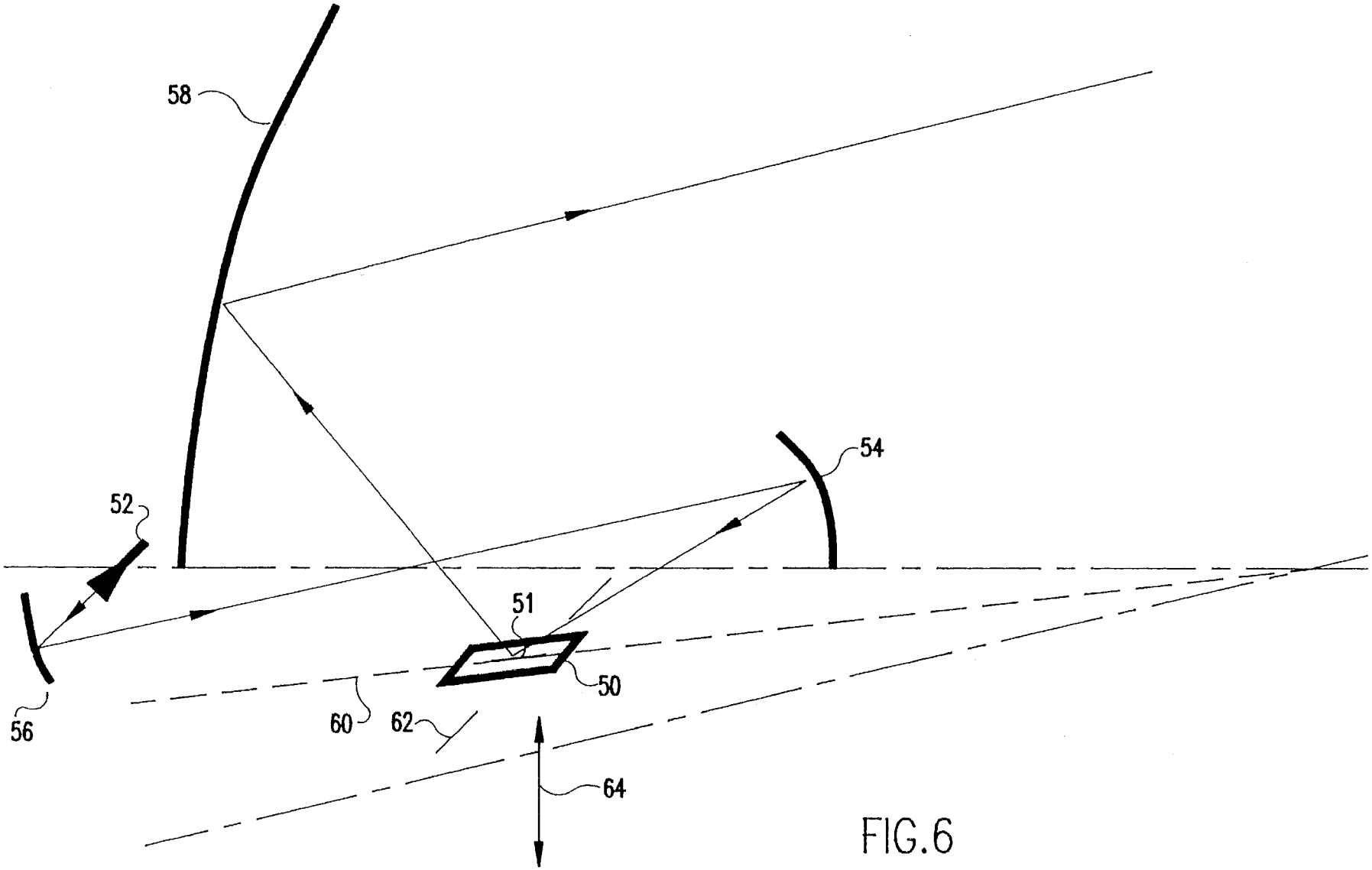
FIG. 6 is a drawing showing the second embodiment of the invention having all reflectors fixed and scanning with a flat mirror.

Referring now to FIG. 6, there is shown an alternate embodiment of the present invention which includes a plane mirror 50. The mirror 50 creates a image of the whole suboptic assembly (including the feed 52, the subreflector 54 and the tertiary reflector 56). Moving the plane mirror 50 about two axes 60 and 62 allows the suboptics assembly as well as the main reflector 58 to be fixed during scan. The mirror 50 is also translated along optimization line 64 which insures that the center of illumination is always at the physical center 51 of the mirror 50.

Figure 7A:
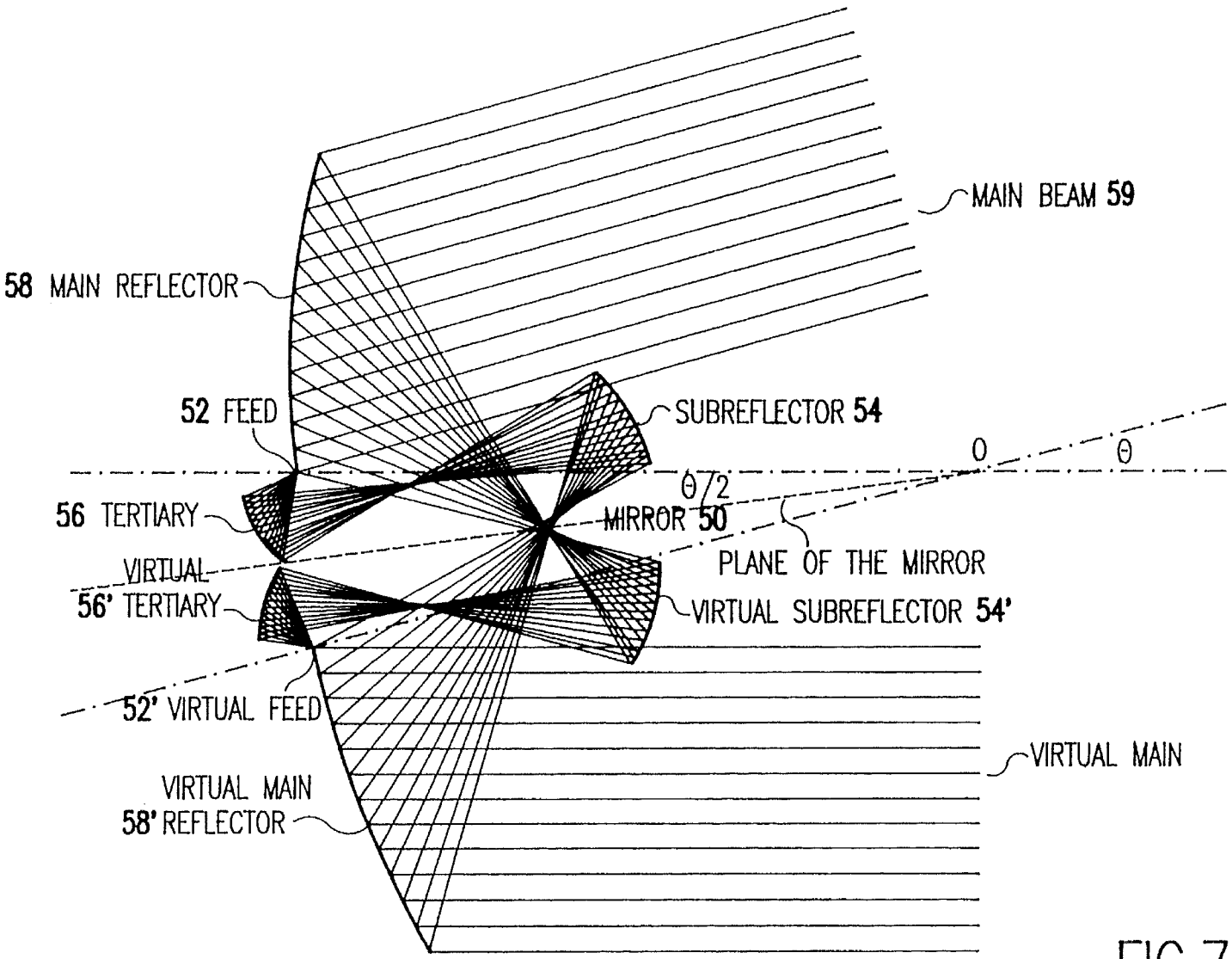
FIG. 7*a* is a drawing showing the mirror virtual image scanning process.
Figure 7B:
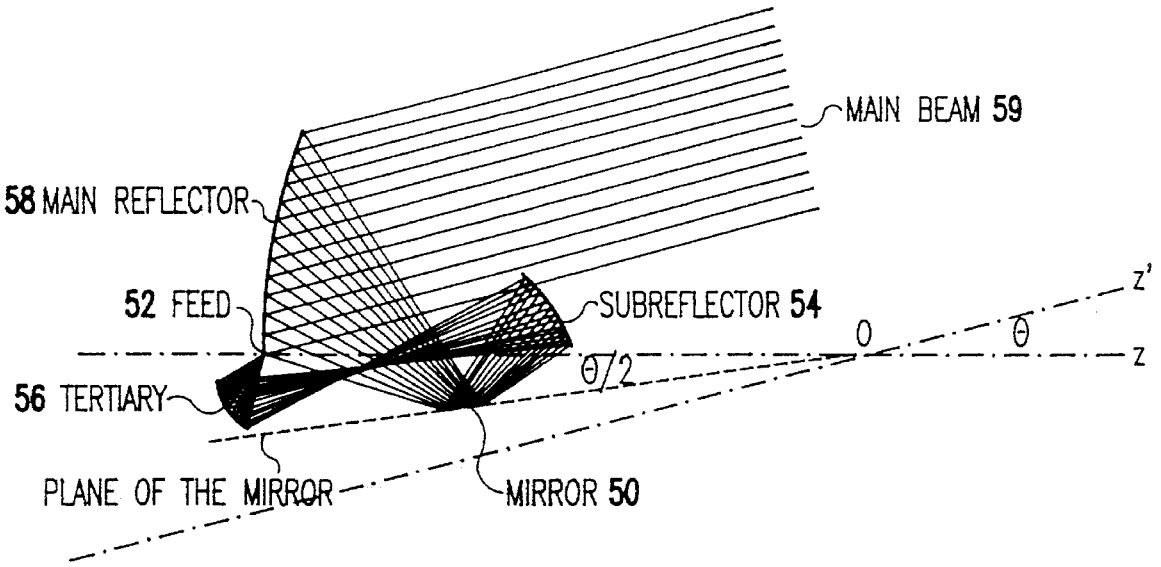
FIG. 7*b* is a drawing showing the real image portion of FIG. 7*a.*

The principles of spherical main reflector scan by mirror imaging is shown in FIGS. 7*a* and 7*b*. As before, the tertiary 56 and sub-reflector 54 correct spherical aberration and provide isotropic uniform mapping. The flat mirror 50 is added to create a virtual image of the suboptics assembly including a virtual feed 52', virtual tertiary reflector 56', and virtual subreflector 54'. Scan is achieved by rotating the mirror plane 50 about the spherical center O, and therefore, rotating the virtual image of the suboptic assembly. The rotation of the virtual image has the same effect as rotating the real image or rotating the actual assembly. Hence, the main beam 59 is scanned accordingly.

TABLE 2

Scan Performance of the Spherical Tri-Reflector Antenna of FIG. 6 with a Main Reflector Diameter of 10 Meters. (Calculations were performed at 15 GHz using GRASP7 and extrapolated to 18 GHz).

| Scan Direction | | Electromagnetic Performance | | | | | | |
|---|---|---|---|---|---|---|---|---|
| | | Gain | Aperture Efficiency | HPBW | BW 10 dB | Beam Efficiency | Side-Lobe Level | XPOL |
| θ | ϕ | (dB) | (%) | (Deg.) | (Deg.) | (%) | (dB) | (dB) |
| 0° | 0° | 62.6 | 51% | 0.12° | 0.2° | 93% | −28 | −25 |
| 5° | 0° | 62.2 | 50% | 0.15° | 0.27° | 92% | −28 | −25 |
| 5° | 90° | 62.6 | 51% | 0.12° | 0.2° | 93% | −28 | −25 |
| 5° | 180° | 62.3 | 50% | 0.12° | 0.25° | 92% | −27 | −25 |

Physical optics analysis with GRASP7 code produced the performance values shown above in Table 2 which shows that the spherical main reflector system can scan the full ±5° region with little performance degradation. The area efficiency, which is defined as the area of the main reflector over the total area of all reflectors, is about 70%.

The most important feature of the proposed configuration is its simplicity in mechanical motion. The flat mirror is rotated about two axis and translated along one line as shown in FIG. 6. One axis 60 is the z' axis and the other axis 62 is the y' which is perpendicular to the plane of the paper. The translation line 64 is the center ray between the subreflector 54 and the virtual main reflector 58' shown in FIG. 7. In addition to the motion of the mirror, the configuration has an azimuth feed tilt motion, which maintains a constant illuminated area of the main reflector 58 when scanning in the $\phi$ direction. This feed tilt motion makes it possible to achieve a 50% aperture efficiency as indicated in Table 2. Error sensitivity analysis shows that for 0.5$\lambda$ transitional error and/or 0.1° rotational error for the reflectors and the feed, the degradation of performance is negligible.

While the invention has been described in terms of a single preferred embodiment, those skilled in the art will recognize that the invention can be practiced with modification within the spirit and scope of the appended claims.

We claim:

1. A method for scanning a spherical antenna having a stationary main spherical reflector in the $\theta$ direction, comprising the steps of:

defining a z-axis passing through an illuminated aperture portion on a main spherical reflector surface said z-axis having its origin at the spherical center of said main spherical reflector;

rotating a suboptic assembly including an electromagnetic feed, about the spherical center in the $\theta$ direction to define a z'-axis, where $\theta$ is the angle between said z-axis and said z'-axis;

tilting said electromagnetic feed relative to said z'-axis during said rotating step such that said illuminated aperture portion on said main spherical reflector surface remains fixed defining a feed to aperture normalization factor as $$q=\frac{1}{2}\left(\frac{U_f}{S_{ap}}\right)R^{-2},$$

where $U_f$ is feed radiation intensity, $S_{ap}$ is aperture power intensity distribution, and R is the radius of the main spherical reflector, and determining a feed tilting angle, $\theta_f$ according to the formula $$\theta'_f=\arccos\left(1-\frac{1}{q}\sin^2\theta\right).$$

2. A scanning tri-reflector spherical antenna system, comprising:

a fixed main spherical reflector;

a fixed suboptic assembly;

a flat mirror for forming a virtual image of said suboptic assembly, said flat mirror moving relative to said fixed suboptic assembly to perform a scan function; and a tilting feed horn for directing electromagnetic waves to said suboptic assembly, said tilting feed horn tilting when said flat mirror is performing said scan function thereby causing the electromagnetic waves to illuminate a fixed aperture area on said main spherical reflector, wherein said suboptic assembly comprises a tertiary reflector, and a sub-reflector, the surface shapes of which are modeled by solving partial differential equations derived by requiring equal-optical lengths from said tilting feed horn to said fixed aperture area, and requiring an isotropic-feed-to-uniform-aperture radiation intensity transformation to correct for spherical aberration and provide uniform, feed-to-aperture mapping.

3. A scanning tri-reflector spherical antenna system as recited in claim 2 wherein said tertiary reflector reflects electromagnetic waves from said tilting feed horn to said sub-reflector, said sub-reflector reflects electromagnetic waves to said flat mirror, and said flat mirror reflects electromagnetic waves to said main spherical reflector.

* * * * *